United States Patent [19]

Yamada et al.

[11] Patent Number: 4,530,322

[45] Date of Patent: Jul. 23, 1985

[54] EXHAUST VALVE FOR DIESEL ENGINE AND PRODUCTION THEREOF

[75] Inventors: Takemi Yamada, Tokyo; Tamataro Satoh, Yokohama; Masaaki Mizushina, Fujisawa; Koji Toyota; Hiromi Okamoto, both of Yokohama, all of Japan

[73] Assignee: Nippon Kokan Kabushiki Kaisha, Tokyo, Japan

[21] Appl. No.: 315,666

[22] Filed: Oct. 28, 1981

[30] Foreign Application Priority Data

Oct. 31, 1980 [JP] Japan ..... 55-152264
Sep. 24, 1981 [JP] Japan ..... 56-149620

[51] Int. Cl.[3] ..... F01L 3/02
[52] U.S. Cl. ..... 123/188 AA; 123/188 S
[58] Field of Search ..... 123/188 AA, 188 S, 668, 123/669; 29/156.7 R, 156.7 A

[56] References Cited

U.S. PATENT DOCUMENTS 1,559,439 10/1925 Kapraun ..... 123/668
3,082,752 3/1963 Thomas ..... 123/668
4,074,671 2/1978 Pennila ..... 123/668
4,376,374 3/1983 Bothwell ..... 123/668

FOREIGN PATENT DOCUMENTS 2856232 7/1980 Fed. Rep. of Germany ..... 123/188 AA

*Primary Examiner*—Parshotam S. Lall
*Assistant Examiner*—W. R. Wolfe
*Attorney, Agent, or Firm*—Moonray Kojima

[57] ABSTRACT

This invention is concerned with an exhaust valve for Diesel engine and a method thereof, in which a seat of the exhaust valve is formed with coated layer comprising ceramics and metals, the layer becoming thicker in density of ceramics as coming nearly to the surface thereof. The seat may be formed with the coated layer by subjecting to pressing-heating treatment after coating. This kind of the exhaust valve is provided by coating ceramics and metals onto a seating portion of the mother material such that ceramics becomes thicker in density as advancing to the surface, and heating the coated layer in electric conductivity while pressing the layer with the tool in non oxidizing atmosphere.

22 Claims, 8 Drawing Figures

EXHAUST VALVE FOR DIESEL ENGINE AND PRODUCTION THEREOF

BACKGROUND ART

The exhaust valve to be used to Diesel engine is easily burnt by exhausted gas, and this is remarkable in middle or high speed Diesel engine issuing the gas of high temperatures, especially in a case of using inferior or bad oil. Such problem involved with burning is in general found in blowing at a valve body and a valve seat composing the exhaust valve. The exhausted gas of Diesel engine much contains, in relation with the fuel, oxides of low melting point as $V_2O_5$ or $Na_2SO_4$, and these oxides penetrate into the seat and cause oxidization accelerated at high temperatures so that said blowing and burning occur. The prior art has employed Cr-heat resisting steel or Ni-based super heat resisting alloy for the mother material of the valve body and the valve seat in order to provide countermeasures to avoid said phenomena. A portion to compose the seat of the mother material is prepared with weld padding or coat padding of corrosion resistible alloy of Co based or Ni based high hardness (Hv 600 to 700). However when the fuel is inferior, the seat would be instantly hurt by blowing and burning, since it is only padded with the corrosion resistible alloy. On the other hand, there has been an attempt for coating on the mother material a substance where ceramics is dispersed in Co based or Ni based alloy, but such coated layer of metals and ceramics uniformly dispersed is poor in durability against repeated shocks. In addition, the coated layer dispersed with ceramics is low in density, and the compound of low melting point which accelerates oxidization at the high temperatures penetrates into the coated layer and further to the mother material, so that the blowing-burning is invited in turn. It may be also assumed to form the seat with ceramic layer for assuring corrosion resistibility, but since such seat is poor in thermal shock resistibility and toughness, cracks or exfoliation are easily effected and its practicability is very difficult.

The present invention is to remove defects as mentioned of the exhaust valve for Diesel engine and is to offer improvement of this kind of exhaust valve.

An object of the invention is to impart excellent corrosion resistibility, thermal shock resistibility and toughness to the seat, and offer such an exhaust valve which exactly avoids the blowing-burning or exfoliation.

Another object of the invention is to offer such an exhaust valve which is imparted with hard property to the seat, thereby to avoid damages by invasion of hard substances in the seat.

Another object of the invention is to offer such an exhaust valve which provides satisfactory adhesion between the seat containing ceramics and the mother material.

Another object of the invention is to offer such an exhaust valve which exactly avoids adhesion of burnt harmful remainders to the seat.

Another object of the invention is to offer such an exhaust valve which is imparted with heat insularity to the seat.

Another object of the invention is to offer such an exhaust valve which is imparted with more excellent corrosion resistibility, thermal shock resistibility, toughness and adhesion with the mother material, by making structure of the seat closer.

A further object of the invention is to offer structure of the seat for obtaining said excellent characteristics, and materials suitable for obtaining said structure.

A still further object of the invention is to offer a method of making an exhaust valve having the above mentioned various characteristics industrially and most efficiently.

BRIEF DESCRIPTION OF THE INVENTION

For attaining the above said objects, the exhaust valve according to the invention is formed with the coated layer of ceramics and metals on the seat, and the coated layer becomes thicker in density ceramics as coming to the surface, and by this structure of the coated layer, corrosion resistibility and toughness of high degree may be provided to the seat. In the other exhaust valve according to the invention, the seat has the same structure as the above mentioned valve, and is formed with the coated layer which has been subjected to the pressing-heating treatment, and by closeness thereby of the structure, the seat is provided with higher corrosion resistibility and toughness. Further, the producing method of the invention coats ceramics and metals on a portion for forming the seat of the mother material such that ceramics becomes higher toward the surface, and this coated layer is heated in electric conductivity while pressing the layer by means of the tool in the non oxidizing atmosphere, thereby enabling to produce the structure of close fabrication.

DETAILED DESCRIPTION OF THE INVENTION

Figure 1:
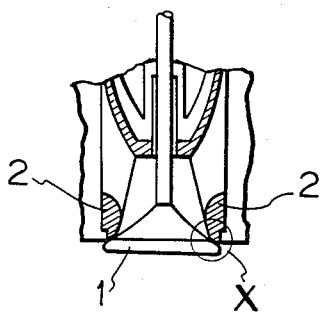
FIG. 1 is a vertically cross sectional view showing the exhaust valve according to the invention.
Figure 2:
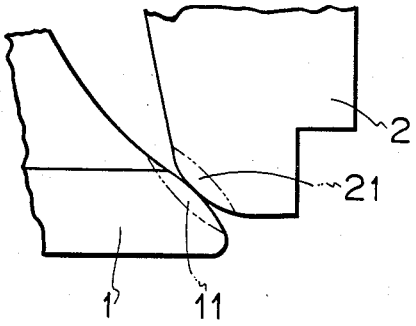
FIG. 2 is a partially enlarged view of X portion in FIG. 1, FIG. 3(*a*) and (*b*) are cross sectional views of the exhaust valves according to the invention.
Figure 3A:
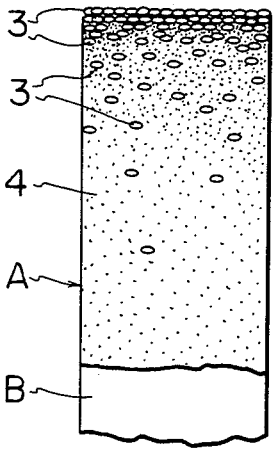
Figure 3B:
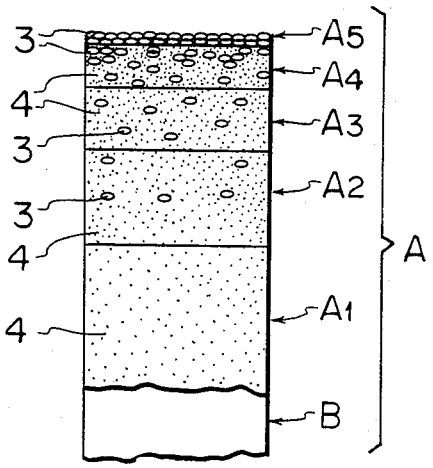

Embodiments of the invention will be explained in referrence to the attached drawings. FIG. 1 shows the exhaust valve according to the invention for Diesel engine, and the exhaust valve is composed of the valve body 1 and the valve seat 2. FIG. 2 enlarges X portion in FIG. 1, and mutual contacting portions of the valve body 1 and the valve seat 2 are seat faces 11, 21. The seat face is formed with the coated layer of metals and ceramics, and the ceramic density becomes thicker as advancing toward its surface. FIG. 3(*a*) and (*b*) show two examples of such coated layers, in which reference A is the coated layer, and B is the mother material of the valve body 1 or the valve seat 2.

In FIG. 3(*a*), the coated layer A has single structure and continuously changes the ceramic density in depth direction of the layer. The coated layer A is almost ceramics 3 at the surface and almost metals 4 (chiefly alloy) at the deep part.

In FIG. 3(*b*), the coated layer has multi layered structure and changes the ceramic density per each of the layers. The coated layer A is composed of A1 to A5 layers being different in the ceramic density. The layer A5 as the uppermost layer is almost ceramics only, and the layer A1 as the lowest layer is almost metals only. The middle layers A2 to A4 are complex of ceramics and metals, and the ceramic density is thicker as going toward the surface, that is, in the order of A2, A3, A4. The coated layer of multi layered structure is optional in 2 layered structure or 3 layered structure. If the layer were double, the upper would be ceramics or complex of ceramics and metals and the lower would be metals. If the layer were triple, the upper would be ceramics, the middle would be ceramics-metals and the lower would be metals, otherwise the upper and the middle layers would be complex of ceramics and metals, and the lower would be metals. In this regard, the present invention should not be limited to such embodiments. It is sufficient that the seat is structured with the coated layer of ceramics and metals in such a manner that the ceramic density is thicker in the upper part and the metal density is thicker in the lower part. With this structure of the coated layer, the seat surface may be given high corrosion resistibility and toughness.

The middle layer shown in FIG. 3(*a*)(*b*) are both complex of ceramics 3 and metals 4, and this complex layer has significance as follows. In view of assuring anti invasion of foreign substances into the seat, it is preferable that the hard layer as ceramics is thicker, but in view of assuring shock resistibility (toughness) and exfoliation resistibility, it is preferable that the ceramic layer is thinner. The complex layer satisfies to a certain extent both requirements opposite each other. By preparing the ceramic-metal complex layer having properly hardness and toughness in the middle layer, shock proof of ceramics may be provided in the surface layer while anti-invasion may be increased. Therefore, a preferred embodiment of the invention is that if the uppermost layer is composed with ceramics only, the middle layer is formed with the ceramic-metal complex layer.

In viewpoint of maintaining anti-corrosion and anti-invasion, it is desirable that the surface layer is composed with ceramics only as seen in FIG. 3(*a*)(*b*). However, among ceramics, especially oxide ceramics (e.g., $ZrO_2$) or nitride ceramics (e.g., BN, SiN) there are such ceramics which could not be enough expected about toughness if not combining metals. Accordingly, in this case, the surface layer is preferable in the ceramic-metal complex layer.

The ceramic-metal complex layer may be made with ceramic grains covered with metals. One coated layer can be formed by appropriately using the metal covered ceramic grains, ordinary ceramic grains and metal grains. One example of using such metal covered ceramic grains is the structure of the ceramic surface layer, the ceramic-metal complex middle layer of the metal covered ceramic grains and the metallic lowest layer. The metal covered ceramic grains may be used for forming the surface layer of the coated layer.

For ceramics to be used as mentioned above, limitation is not specially made to, but various kinds could be employed in oxides, carbides, nitrides and others. Representatives will be $Al_2O_3$, $TiO_2$ and $ZrO_2$. For the metals, alloys are main as NiCrAl, NiCrCo and NiCrMo. It is preferable to use several kinds of metals having different characteristics of corrosion resistibility and strength with respect to the coated layer. That is, the surface layer is formed with metals excellent in corrosion resistibility (e.g., NiCrAl) and the lowest layer is formed with metals excellent in strength (e.g., NiCrMo) and the middle layer is composed with metals having properly corrosion resistibility and strength (e.g., NiCrCo).

A next reference will be made to thickness of coated layer. If the surface is composed with ceramics only, thickness thereof will be preferable in range between 30 and 500 microns in order to satisfy corrosion resistibility and thermal shock resistibility. In order to exactly avoid penetration of molten oxides into the mother material, at least 70 microns will be required for thickness. The upper limit of 500 microns is a limit value where cracks are not generated even if the surface layer is heated and soaked at 800° C. and water cooled (in a case of 100 microns in thickness of the lower metal layer), and it is actually preferable that the limit is 100 microns.

Thickness of the lower metal layer depends upon coarseness of the base (mother material), and it is assumed to require at least 100 microns for absorbing thermal shock or shocks when opening and closing the valve, and less than 1000 microns are suitable in economical viewpoint.

Overall thickness of the coated layer will be around 130 to 6000 microns, and practically 350 to 2000 microns. If the double structure has the upper layer of ceramics and the lower layer of metals, the most suitable thickness will be 250 to 400 microns.

In the invention, the seat surface is composed with the coated layer by subjecting to the pressing-heating treatment. This structure of the seat surface is the same as having menioned. Passing through this treatment, the structure of the coated layer is made closer and is given larger toughness, corrosion resistibility and anti-invasion to the seat surface.

The pressing-heating treatment will be referred to in detail.

Actual embodiments will be shown.

EXAMPLE 1

Figure 4:
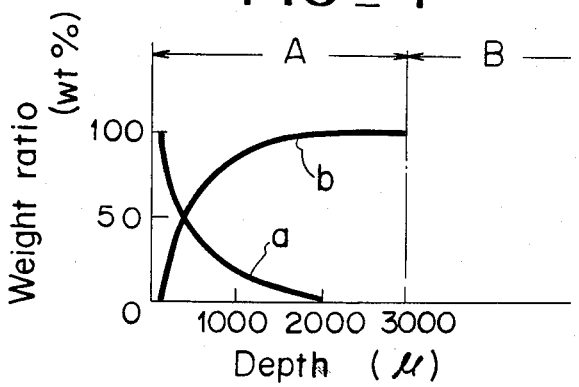
FIG. 4 is a graph showing dispersion of weight ratio of ceramics and metals in the direction toward the surface of the seat of the exhaust valve in Example 1.

Ceramics: $Al_2O_3$(60%)+$TiO_2$(30%)+$ZrO_2$(10%)
Metal: NiCrAl Alloy (Colmonoy 6)
Mother material: Nimonic Alloy Ceramics and metals as the above mentioned were coated on the mother material in such a manner that the ceramic density continuously changed as shown in FIG. 3(*a*). FIG. 4 shows distributions of ceramics and metals in the present embodiment, and (a) is ceramics and (b) is metals. The coated layer was 3000 microns in total thickness, in which the portion of 0 to 30 microns from the surface was the layer of 100% ceramics and the portion of 2000 to 3000 microns was 100% metal, and in the scope of 30 to 2000 microns the ceramic-metal complex layer was formed where the ceramic density was thicker at the upper part.

EXAMPLE 2

The coated layer of ceramics and metals is as under.

| Depth (microns) | Composition |
|---|---|
| 0 to 30 | $Al_2O_3$(60%) + $TiO_2$(40%) |
| 30 to 150 | [$Al_2O_3$(60%) + $TiO_2$(30%) + NiCr(10%)](65%) NiCrAl(35%) |
| 150 to 500 | [$Al_2O_3$(90%) + NiCr(10%)](35%) NiCrAl(65%) |
| 500 to 2000 | [$Al_2O_3$(90%)+ NiCr(10%)](15%) NiCrAl(85%) |
| 2000 to 3000 | NiCrAl (Colmonoy 6) |
| Mother material | Nimonic Alloy |

The present embodiment used the materials as above said to compose the coated layer of a plurality of layers being different in the ceramic density so that the ceramic density was stepwise changed. The coated layer of 3000 microns in thickness was composed of 5 layers in total, and from the surface the layer of 0 to 30 microns was the 100% ceramic layer, the layer of 2000 to 3000 microns was the 100% metal layer, and the middle three layers were the ceramic-metal complex layer where the ceramic density was higher at the upper part.

EXAMPLE 3

Investigations were made to the exhaust valves of the invention of several embodiments as shown in under table and the comparative one of the coated layer having ceramics only with respect to the characteristics thereof. In them, (1) to (4) were the inventive exhaust valves, and (5) was the comparative valve. In the exhaust valve (1), the upper was ceramics and the lower was metals. In the valve (2), the upper was the ceramic-metal complex layer and the lower was metals. In the valve (3), the upper was the complex layer of the metal covered ceramic grains and the lower was metals, and in this complex layer the covering metal was 0 to 75 wt % of the total grains. The valve (4) was made by performing the pressing-heating treatment on the coated layer of the valve (3). The comparative valve (5) was formed with the ceramic coated layer on the ground treatment.

| Coated layers | |
|---|---|
| (1) Lower side: 80Ni—20Cr | 100 to 200 microns |
| Upper side: $Al_2O_3.TiO_2$ | 150 to 500 microns |
| (2) Lower side: 80Ni—20Cr | 100 to 200 microns |
| Upper side: $Al_2O_3$ 80% 50Cr—50Ni 20% | 150 to 500 microns |
| (3) Lower side: 80Ni—20Cr | 100 to 300 microns |
| Upper side: 50Cr—50Ni (75 to 0%) Covering $Al_2O_3.TiO_2$ (25 to 100%) | 200 to 800 microns |
| (4) Lower side: Same as above Upper side: Same as above (Pressing-heating after coating) | |
| (5) $Al_2O_3.TiO_2$ (Base: 80Ni—20Cr | 100 to 200 microns 50 microns) |

Figure 5:
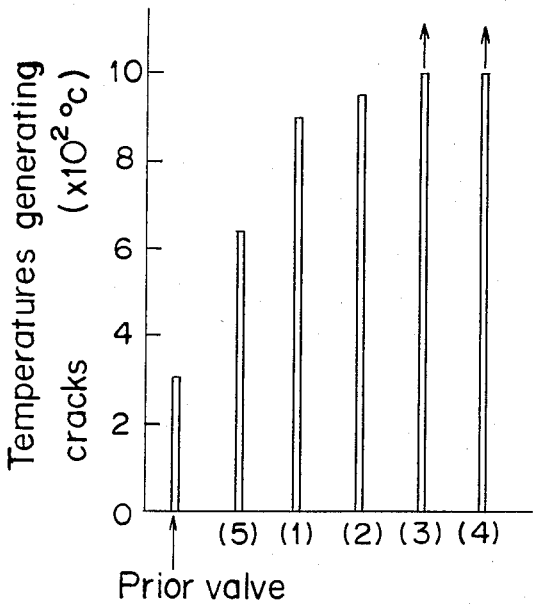
FIG. 5 is a graph showing comparison of thermal shock resistibility of the exhaust valve in Example 3 with an ordinary exhaust valve.

The exhaust valve (5) having the seat surface of ceramics only caused the exfoliation on the surface in 150 hr in the actual work, and the overall ceramic layer was exfoliated in 1400 hr. On the other hand, in the invention, exfoliations were found as follows, the valve (1): 2500 to 3500 hr, the valve (2): 3500 to 5000 hr, the valve (3): 5000 to 7000 hr, and the valve (4): 7000 to 10000 hr. Further, in order to appreciate the anti-invasion into the seat surface, the vickers hardness was tested to measure the loading value creating cracks in the seat surface. Cracks were created at pressure of 300 to 500 g. On the other hand, the valve (1) was cracked at pressure of 300 to 500 g, but the others were cracked as follows, the valve (2): more than 1 Kg, the valve (3): more than 1 to 5 Kg, the valve (4): more than 10 to 30 Kg. FIG. 5 shows thermal shock resistibility (temperatures when immersing into the water after heating and generating cracks) of the valves (1) to (4) and the conventional one (weld padding on the seat surface). In this figure, although the valve (5) shows satisfactory thermal shock resistibility in comparison with the conventional one, it could not fully absorb thermal shock due to difference in thermal expansion between the ceramics layer and the mother material, and so cracks were created at the heating temperature of 650° C. On the other hand, the inventive valves (1) to (4) all showed the satisfactory thermal shock resistibility over the exhaust valve (5).

As having discussed, the exhaust valve of the invention is formed with the seat surface by coating ceramics and metals such that the ceramic density becomes thicker as advancing toward the surface, and may provide characteristics as follows. That is, due to ceramics more contained at the upper part, the seat is made excellent in hardness at the high temperatures and corrosion resistibility, and the corrosion amount at the high temperatures may be reduced ½ to 1/10 of the conventional exhaust valve (weld padding on the seat). Said ceramics avoids penetration of oxides of low melting point such as $V_2O_5$, $Na_2SO_4$ and others into the interior of the seat and avoids occurrence of accelerated oxidation at high temperatures, thereby exactly avoiding blowing-burning due to this accelerated oxidation. Since ceramics brings about reaction with said low melting oxides as high as around 900° C., the high temperature corrosion due to the low melting oxides scarecely takes place in the range of 600° to 700° C. where the seat of the exhaust valve serves. In addition to these characteristics, metals contained much in the lower part make the seat surface tough and excellent in adhesion with the mother material. This characteristic property is remarkable when the ceramic-metal complex layer is prepared for the surface layer and the middle layer. Furthermore, under mentioned characteristic properties may be obtained by the surface ceramics. High hardness is imparted on the seat surface by the surface ceramics, so that the blowing loss on the seat by invasion of hard substances can be prevented. Ceramics on the surface layer keep off adhesion of harmful substances as burnt remainders to the seat surface, and further due to the heat insulating effect of ceramics, temperature around the seat surface may be considerably lowered in corporation with water cooling.

In the present exhaust valve the fabrication of the coated layer, especially of the ceramic layer is made close, thereby to obtain higher corrosion resistibility and toughness, and besides by making close the whole fabrication the adhering property with the mother material can be more improved, and thus the blowing-burning, exfoliation and others can be exactly avoided.

A further reference will be made to a method of making the exhaust valves.

An example of a prior process to coating will be briefly referred to. The mother material (valve body and seat) is under-cut on a portion to be formed with the seat in accordance with thickness of a coating layer, and subsequently this portion is blasted with white alumina, and removal of blast powder and degrease are undertaken. Coating is carried out after this process. Ceramic grains, metal covered ceramic grains and metal grains are coated at determined ratio on the portion to be a seat such that the ceramic density becomes higher as going to the surface. Herein, for making the coated layer as shown in FIG. 3(*a*), the coating is performed by continuously changing the mixing ratio of said grains. For making the coated layer as shown in FIG. 3(*b*), the coating is performed by stepwise coating a plurality of materials being different in the mixing ratio of said grains.

The process may depend upon the plasma, the thermospray or other suitable ways. In said coatings, it is possible to properly use metals of several kinds being different in the characteristics (anti-corrosion, toughness, etc) in coating height of the coated layer.

The exhaust valve according to the invention has practical durability, though the seat surface is as-coated. Durability is more increased by undertaking the pressing-heating treatment on the coated layer. This treatment is done by heating the coated layer in the non-oxidizing atmosphere while pressing it. The treating order is different in continuously changing the ceramic density as shown in FIG. 3(*a*) and in stepwise changing the ceramic density as shown in FIG. 3(*b*). In FIG. 3(*a*), the mixing ratio of the grains is continuously changed to integrally form the coated layer, and subsequently the pressing-heating treatment is provided. On the other hand, in FIG. 3(*b*), the layers different in the mixing ratio of the grains, are formed in succession from the lowest side, and the finished layers are subjected to the pressing-heating treatment, in other words, coatings and treatings are repeated several times to form the coated layer.

Figure 6:
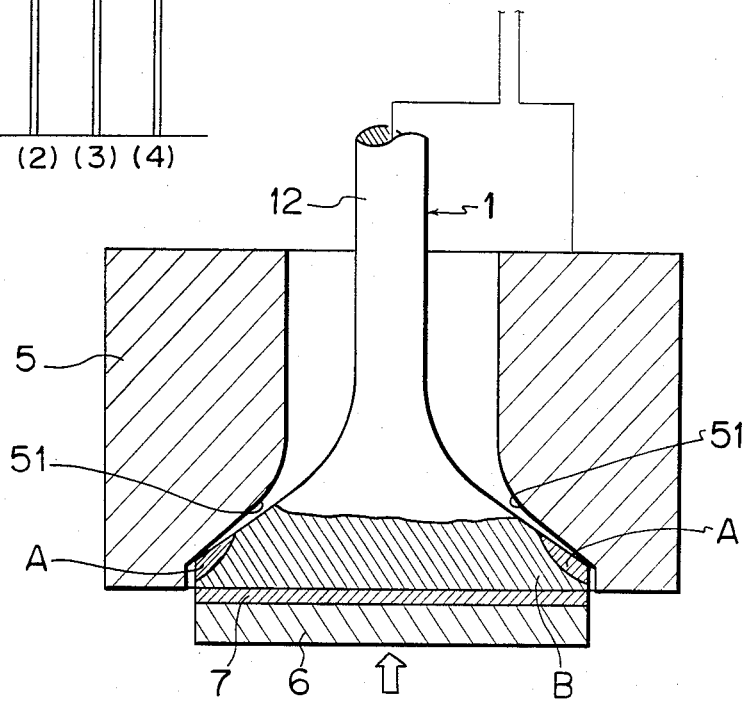
FIG. 6 is an explanatory view showing the pressing-heating treatment subjecting to the coated layer of the seat of the valve body.
Figure 7:
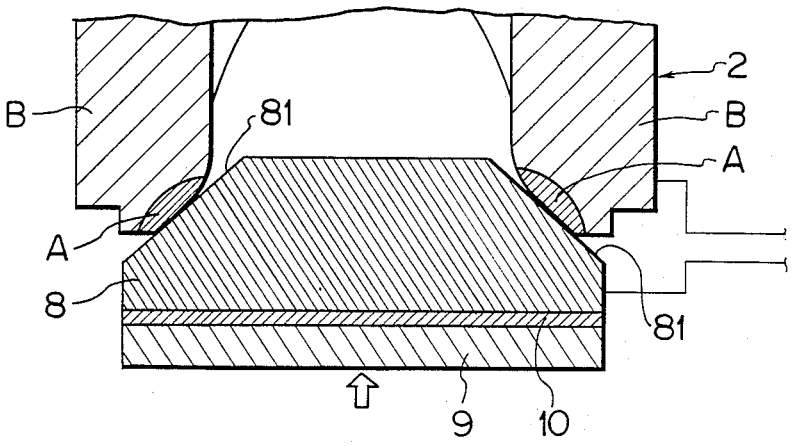
FIG. 7 is an explanatory view showing the pressing-heating treatment subjecting to the coated layer of the seat of the valve seat.

FIGS. 6 and 7 show the pressing-heating conditions. FIG. 6 is concerned with the valve body. The valve body 1 is inserted into a tool 5 at its corresponding part, and the coated layer A is contacted to an inner circumference 51 of taper. A tool 6 is urged to a lower surface of the valve body 1 via an insulator 7, and the coated layer A is pressed to the inner circumference 51 of the tool 5 at determined static load. Under this condition electric conductivity is made between a valve bar 12 and the tool 5 to heat the coated layer A.

FIG. 7 is concerned with the valve seat. The coated layer A is contacted to an outer circumference 81 of taper of a tool 8. A tool 9 is urged to a lower surface of the tool 8 via an insulator 10, and the coated layer A is pressed to the outer circumference 81 of the tool 8 at determined static load. Under this condition, electric conductivity is made between the valve seat 2 and the tool 8 to heat the coated layer A.

The pressing-heating tool is made of, e.g., Nimonic alloy and has coating of solid lubricant (e.g., graphite lubricant) on the contacting face with the coated layer A.

The coated layer A should be heated in temperature range below the melting point of the substances forming the coated layer. The heating temperature is around 900° C. to the maximum and in general 700° to 800° C. Conductivity of 200 V and 30 Kw is required for the heating. Static load for conductive heating should be to the extent that creep deformation of the mother material can be ignored, and therefore limit is 10 $Kg/mm^2$ and generally 3 to 7 $Kg/mm^2$. For the non-oxidizing atmosphere, inert gas is, e.g., Ar gas where the treatment is undertaken.

We claim:

1. Exhaust valve for Diesel engine, wherein a seat surface thereof is formed with at least one coated layer comprising ceramics and metals, the coated layer increasing substantially constantly in density of said ceramics towards an upper surface thereof.

2. Exhaust valve for Diesel engine, wherein a seat surface is formed with at least one coated layer comprising ceramics and metals, which increases substantially constantly in ceramic density towards said surface and is provided with pressing-heating treatment.

3. Exhaust valve for Diesel engine as set forth in claim 2 wherein an coated layer comprises the ceramic and metal complex layer at an uppermost layer.

4. Exhaust valve for Diesel engine, wherein a seat surface is formed with at least one coated layer comprising ceramics and metals, which increases in ceramic density towards said surface and is provided with pressing-heating treatment, and wherein said coated layer comprises a single structure which continuously changes the ceramic density in height of the layer.

5. Exhaust valve for Diesel engine as set forth in claim 4, wherein the coated layer comprises ceramics at an uppermost layer.

6. Exhaust valve for Diesel engine as set forth in claim 4, wherein metal grains of more than two kinds are used.

7. Exhaust valve for Diesel engine as set forth in claim 6, wherein metals having excellent corrosion resistibility are used at the surface side, and metals having excellent strength are used at the lower side.

8. Exhaust valve for Diesel engine as set forth in claim 4 wherein the coated layer comprises a ceramic and metal complex layer, and a lowest layer is metals.

9. Exhaust valve for Diesel engine as set forth in claim 8, wherein the ceramic and metal complex layer comprises ceramic grains and metal grains.

10. Exhaust valve for Diesel engine as set forth in claim 8, wherein the ceramic and metal complex layer comprises ceramic grains and metal grains.

11. Exhaust valve for Diesel engine as set forth in claim 8, wherein metals of more than two kinds are used for metals.

12. Exhaust valve for Diesel engine, wherein a seat face thereof is formed with at least one coated layer comprising ceramics and metals, the coated layer increasing in density of said ceramics towards an upper surface thereof, and wherein said coated layer comprises a single structure which continuously changes the ceramic density in height of said layer.

13. Exhaust valve for Diesel engine as set forth in claim 12, wherein metal grains of more than two kinds are used.

14. Exhaust valve for Diesel engine as set forth in claim 12, wherein metals having excellent corrosion resistibility are used at the surface side, and metals having excellent strength are used at the lower side.

15. Exhaust valve for Diesel engine as set forth in claim 12, wherein the coated layer comprises a ceramic and metal complex layer at an uppermost layer.

16. Exhaust valve for Diesel engine as set forth in claim 15, wherein the ceramic and metal complex layer comprises metal covered ceramic grains and metal grains.

17. Exhaust valve for Diesel engine as set forth in claim 15, wherein the ceramic and metal complex layer comprises ceramic grains and metal covered ceramic grains.

18. Exhaust valve for Diesel engine as set forth in claim 12, wherein metals of more than two kinds are used for metals.

19. Exhaust valve for Diesel engine as set forth in claim 18, wherein ceramic grains covered with metals of more than two different kinds are used.

20. Exhaust valve for Diesel engine as set forth in claim 18, wherein metals of metal grains and metals of metal covered ceramics are different kinds in the coated layer comprising metal grains and metal covered ceramic grains.

21. Exhaust valve for Diesel engine as set forth in claim 20, wherein metal grains of more than two kinds are used

22. Exhaust valve for Diesel engine as set forth in claim 20, wherein metal covered ceramic grains of more than two kinds covered with different metals are used.

* * * * *